US008448560B1

(12) United States Patent
Gonzalez

(10) Patent No.: US 8,448,560 B1
(45) Date of Patent: May 28, 2013

(54) PROPELLED IMPACTER REACTIVE ARMOR

(75) Inventor: Rene' G. Gonzalez, Southfield, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 209 days.

(21) Appl. No.: 13/105,507

(22) Filed: May 11, 2011

(51) Int. Cl.
*F41H 5/007* (2006.01)

(52) U.S. Cl.
USPC ..... 89/36.17

(58) Field of Classification Search
CPC ..... F41H 5/007
USPC ..... 89/36.01, 36.17
See application file for complete search history.

(56) References Cited

U.S. PATENT DOCUMENTS

| | | | | |
|---|---|---|---|---|
| 703,839 | A | 7/1902 | Scott | |
| 703,840 | A | 7/1902 | Scott | |
| 1,276,082 | A | 8/1918 | Kuhn | |
| 1,376,530 | A | 5/1921 | Greener | |
| 1,455,097 | A * | 5/1923 | Doren John B Van | 102/360 |
| 4,285,153 | A * | 8/1981 | Crouch | 42/84 |
| 4,348,958 | A | 9/1982 | Day | |
| 4,368,660 | A | 1/1983 | Held | |
| 4,664,033 | A | 5/1987 | Burkdoll et al. | |
| 4,665,794 | A | 5/1987 | Gerber et al. | |
| 4,981,067 | A | 1/1991 | Kingery | |
| 5,025,707 | A | 6/1991 | Gonzalez | |
| 5,293,806 | A | 3/1994 | Gonzalez | |
| 5,637,824 | A | 6/1997 | Benyami | |
| 5,824,941 | A | 10/1998 | Knapper | |
| 6,311,605 | B1 | 11/2001 | Kellner et al. | |
| 6,345,563 | B1 | 2/2002 | Middione et al. | |
| 6,557,929 | B2 | 5/2003 | Fox et al. | |
| 6,846,372 | B1 | 1/2005 | Guirguis | |
| 7,210,412 | B2 | 5/2007 | O'Dwyer | |
| 7,350,451 | B2 | 4/2008 | Barisciano, Jr. | |
| 7,424,845 | B2 | 9/2008 | Zank et al. | |
| 7,540,229 | B2 | 6/2009 | Seo et al. | |
| 7,743,705 | B2 | 6/2010 | O'Dwyer | |
| 2005/0211086 | A1 * | 9/2005 | Mayseless | 89/36.17 |
| 2006/0065111 | A1 | 3/2006 | Henry | |
| 2006/0162539 | A1 | 7/2006 | Fucke et al. | |
| 2009/0173250 | A1 | 7/2009 | Marscher et al. | |

OTHER PUBLICATIONS

Roman Candles; retrieved from www.pyrouniverse.com on Nov. 1, 2010.
Roman Candles: Information; retrieved from www.answers.com on Nov. 1, 2010.
Newhouse, Paul, A Primer on Shaped Charges, The Small Arms Review, vol. 11, No. 1, Oct. 2007, pp. 94-97.

* cited by examiner

*Primary Examiner* — Gabriel Klein
(74) *Attorney, Agent, or Firm* — Thomas W. Saur; David L. Kuhn; Luis Miguel Acosta

(57) ABSTRACT

A reactive armor that includes a tube; end caps installed on the ends of the tube; a plurality of impacters included inside of the tube; explosive included between the impacters and between the end caps and the impacters; and one or more passages, wherein the passages provide communication such that when a threat ruptures the tube, the propellant is progressively ignited from the rupture; and, except for the rupture that results from intrusion of the threat, the tube remains essentially intact.

7 Claims, 1 Drawing Sheet

PROPELLED IMPACTER REACTIVE ARMOR

GOVERNMENT INTEREST

The invention described here may be made, used and licensed by and for the U.S. Government for governmental purposes without paying royalty to me.

BACKGROUND OF THE INVENTION

1. Field of the Invention

The present invention generally relates to reactive armor, and in particular, to a propelled impacter reactive armor.

2. Background Art

Conventional reactive armor structures and systems that are configured to defeat projectile and/or other threats include systems and methods that have been implemented with varying degrees of success since the 1970's. One example of prior art armor can be found in, for example, U.S. Pat. No. 4,368,660 ('660). As recited in the Abstract, the '660 patent discloses: "A protective arrangement against projectiles is a wall structure formed from a wall layer of explosive material, and at least one additional wall layer covering at least one face of the wall layer of explosive material. The additional wall layer is made of a non-explosive, inert high-density material such as metal. In one embodiment both faces of the explosive wall layer are covered with a layer of inert, non-explosive high-density material such as metal. The protective arrangement is particularly suitable for protection against the destructive force of hollow explosive charge projectiles."

U.S. Pat. Nos. 4,665,794; 4,981,067; 5,025,707; 5,293,806; 5,637,824; 5,824,941; 6,311,605; 6,345,563; 6,846,372; 7,424,845; 7,540,229; and U.S. Published Applications 2006/0065111; 2006/0162539; and 2009/0173250 also provide additional examples of some conventional protective armoring structures and systems.

However, conventional reactive armor generally presents compromises and limitations in performance, generally manifested as inadequate performance against threats and/or potential hazard to nearby individuals and/or equipment, collateral damage, and the like. In many cases, conventional reactive armors are either too fast reacting or too slow reacting for effective defeat of some threats. For example, conventional reactive armor implementations may react quickly enough to degrade a shaped charge threat, but are spent before the second charge in a tandem charge arrives. In other examples, the conventional reactive armor implementations may be slow, reacting at a rate suitable to effectively degrade a long rod penetrator, but moving too slowly to have good effect on a shaped charge jet. As such, there is a desire for improved reactive armor.

SUMMARY OF THE INVENTION

Accordingly, the present invention may provide a reactive armor that includes a tube; end caps installed on the ends of the tube; a plurality of impacters included inside of the tube; explosive included between the impacters and between the end caps and the impacters; and one or more passages, wherein the passages provide communication such that when a threat ruptures the tube, the propellant is progressively ignited from the rupture; and, except for the rupture that results from intrusion of the threat, the tube remains essentially intact.

The reactive armor that includes the tube and the end caps formed from at least one of steel, aluminum, composite, cermet, and ceramic.

The reactive armor that includes the impacters formed from at least one of steel, titanium, aluminum, composite, cermet, and ceramic.

The reactive armor that includes the passages implemented in connection with the impacters.

The reactive armor that includes the passages implemented in connection with the inside surface of the tube.

The reactive armor further includes a communication modifier, wherein the communication modifier seals, wholly or in part, the passage after the ignition of the explosive at one section within the tube has been communicated to a next charge of the explosive.

The reactive armor, wherein the communication modifier further comprises a bidirectional check valve in the impacter.

The reactive armor, wherein the bidirectional check valve has a barbell shape.

The reactive armor, wherein the bidirectional check valve comprises a metal ball that is held within an expanded region in the passage by a retainer that is snugly fit in the passage.

The reactive armor, wherein the bidirectional check valve has a barbell shape and the ends of the barbell have a tappet shape.

The reactive armor, wherein the communication modifier further includes a restriction within the passage.

The reactive armor, wherein the communication modifier further includes a flap that is positioned at the entrance of the passage.

The reactive armor, wherein the communication modifier further includes a shaped charge that is positioned at the entrance of the passage and is held in place by a strut, wherein, in response to the ignition of the explosive, the shaped charge generates a jet and a slug that are directed into the passage.

The reactive armor, wherein the impacters further include tapered, cone shaped with narrow end inwardly oriented hollowed out regions at one or both ends of the impacter.

The reactive armor, wherein the impacters are substantially adjacent.

The reactive armor, wherein the reactive armor further includes an end sleeve positioned inside of the tube and between the outermost impacter and the end cap.

The reactive armor, wherein the retainer further includes a frangible glass bead or an adhesive.

The reactive armor, wherein the retainer further includes a material that is combustible.

The reactive armor, wherein the restriction has a diameter that is in the range of 3% to 15% of the outside diameter of the impacter.

The reactive armor, wherein the shaped charge has an outside diameter in the range of 5% to 25% of the outside diameter of the impacter.

The above features, and other features and advantages of the present invention are readily apparent from the following detailed descriptions thereof when taken in connection with the accompanying drawings.

DETAILED DESCRIPTION OF THE PREFERRED EMBODIMENT(S)

Definitions and Terminology

Figure 1:
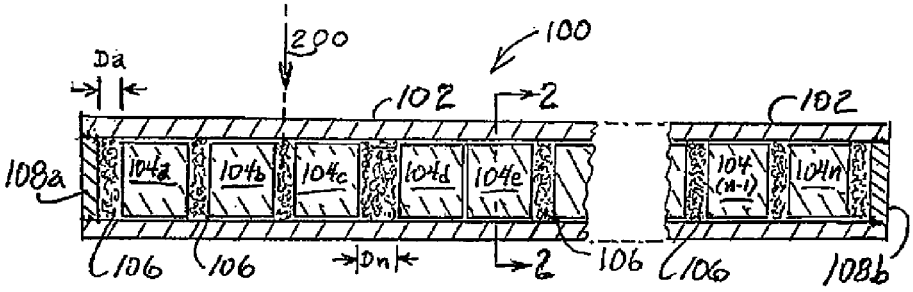
FIG. 1 is a diagram of a partial sectional view of an embodiment of a propelled impacter reactive armor.

The following definitions and terminology are applied as understood and used by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated.

A plurality of items, structural elements, compositional elements, materials, subassemblies, and the like may be presented in a common list or table for convenience. However, these lists or tables should be construed as though each member of the list is individually identified as a separate and unique member. As such, no individual member of such list should be considered a de facto equivalent of any other member of the same list solely based on the presentation in a common group so specifically described.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

With reference to the Figures, the preferred embodiments of the present invention will now be described in detail. Generally, the present invention provides an improved system for a propelled impacter reactive armor. The reactive armor of the present invention may advantageously address (i.e., defeat or reduce the effect of) segmented kinetic energy threats, and also effectively defeat common projectile threats against which rapid reaction combined with sustained reaction is generally beneficial.

Referring to FIG. 1, a partial sectional view of an embodiment of a propelled impacter reactive armor (e.g., apparatus, device, system, assembly, etc.) 100 is shown. The armor 100 generally comprises a tube (e.g., case, shell, housing, container, encapsulation subassembly, etc.) 102; at least one, and generally more than one (i.e., a plurality), impacter (e.g., piston, interrupter, disruptor, projectile, etc.) 104 (e.g., impacters 104*a*-104*n*); a propellant (e.g., energetic material, pyrotechnic, explosive, and the like) 106; and end caps (e.g., plugs, covers, opening encapsulators, retainers, and the like) 108 (e.g., end caps 108*a* and 108*b*).

The end caps 108 are generally installed (i.e., fixed, fastened, crimped, threaded (as illustrated on FIGS. 1 and 3), adhered, etc.) on the respective ends of the tube 102; the plurality of impacters 104 are generally included inside of the tube 102; and the propellant 106 is generally included as a series of charges between the impacters 104 as well as between the end caps 108 and the impacters 104 that are located closest to the end caps 108. In alternative embodiments (not illustrated), the armor 100 may be implemented having a non-cylindrical cross sectional shape (e.g., square, hexagonal, etc.).

The tube 102 is generally implemented having a hollow cylindrical (i.e., tube, pipe, etc.) shape. The tube 102 and the end caps 108 are generally made from a rugged, strong material such as steel or aluminum, or, alternatively, any other suitable material for pressure containment, usually metal; however, may also include composites, cermets, ceramics, and the like; and having a wall thickness that is capable of withstanding the pressures that may be generated when the explosive 106 is ignited.

The impacters 104 are generally implemented having a cylindrical (i.e., piston, short rod, and the like) shape. The longitudinally positioned elements (e.g., end caps 108 and impacters 104) are generally separated by a distance D (e.g., separations Da and Dn); however, in some examples, the separation D may be about zero. For example, the impacter 104*a* and the end cap 108*a* may have a longitudinal separation of Da; the impacters 104*c* and 104*d* may have a longitudinal separation of Dn, where Dn>Da; and the impacters 104*d* and 104*e* may be substantially adjacent. As such, the longitudinal separation distance, D, between longitudinally positioned elements (e.g., end caps 108 and impacters 104) is not necessarily equal in all instances.

The plurality of impacters 104 are generally sized to snugly (i.e., sealably) and movably (i.e., longitudinally slidingly) fit within the interior of the tube 102. While illustrated having similar length, the plurality of impacters 104 are not necessarily equal in length. The impacters 104 are generally made from a material that is ballistically resistant such as steel, titanium, aluminum, composite, cermet, ceramic, and the like.

A threat 200 may rupture (e.g., puncture, pierce, etc.) the case 102. The threat 200 may include such threats as one or more projectiles, segmented rounds, metal fragments, fluid metals, penetrating jets ("thorns", "spikes", etc.) as generated by chemical energy rounds, high energy kinetic rounds, and the like. The propellant 106 is generally implemented as a granular (or, alternatively, solid cast, pressed, liquid, etc.) explosive material that is ignitable (e.g., detonated, deflagrated, set off, exploded, etc.) by the intrusion of the threat 200 through the tube 102.

The threat 200 generally ruptures the case 102 locally, and ignites the series of charges of the propellant 106; however, except for the rupture that results from the intrusion of the threat 200, the case 102 generally remains essentially intact. When the separation distance, D, is zero or about zero, the reaction time of the propelled impacter reactive armor 100 to the threat 200 is generally enhanced (i.e., faster).

Figure 2A:
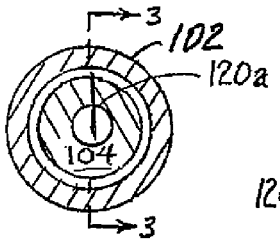
FIGS. 2A-2C are diagrams of cross sectional views of alternative embodiments of a communication element of the armor of FIG. 1.
Figure 2B:
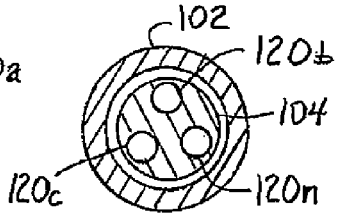
Figure 2C:
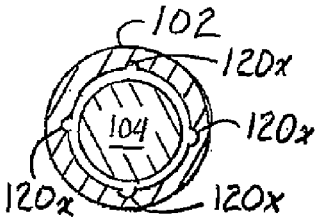

Referring to FIGS. 2A-2C, diagrams illustrating cross sectional views, taken at line 2-2 of FIG. 1, of alternative embodiments of the armor 100 are shown. For clarity, illustration of the explosive 106 is omitted. The reactive armor 100 may further comprise one or more passages (e.g., orifices, channels, throughways, holes, vias, tunnels, passageways, communication elements, and the like) 120 that provide communication such that, when the threat 200 ruptures the tube 102, the explosive propellant 106 is progressively (e.g., serially, longitudinally, along the main axis of the case 102, etc.) ignited from the rupture through the inside of the tube 102.

Ignition and explosion of the propellant 106 generally proceeds serially from the rupture throughout the interior of the tube 102 by way of the passage 120. The gap between the inside wall of the case 102 and the impacter 104 is exaggerated in FIGS. 2A-2C for clarity. In one example, the passage 120 may be formed having a uniform cross section; however, as discussed in connection with FIGS. 2A-2C and FIG. 3, other alternative embodiments of the channel 120 may be implemented to meet the design criteria of a particular application.

In one embodiment (e.g., as illustrated in connection with FIG. 2A), the passages 120 may be implemented in connection with the impacters 104 as a single passage (e.g., impacter passage 120*a*). Alternatively, in another embodiment (e.g., as illustrated in connection with FIG. 2B), the passages 120 may be implemented in connection with the impacters 104 as a plurality of passages (e.g., impacter passages 120*b*-120*n*). While illustrated as having substantially the same cross sectional shape and area, the passages 120*b*-120*n* may be implemented having any different shapes and areas to meet the design criteria of a particular application. Alternatively, in yet another embodiment (e.g., as illustrated in connection with FIG. 2CB), one or more of the passages 120 may be implemented in connection with the case 102 (e.g., case passages 120*x*).

While illustrated as having substantially the same cross sectional shape and area, the passages 120*x* may be implemented having any different shapes and areas to meet the design criteria of a particular application. Further, the passage 120 may be modified to alter the communication as is described below in connection with FIG. 3. In yet another embodiment (not illustrated), the passages 120*a*-120*n* and 120*x* may be implemented alone or in combination in the reactive armor 100.

Figure 3:
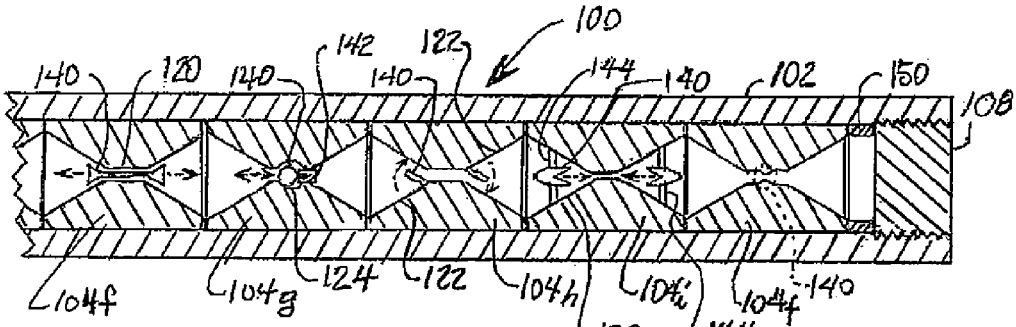
FIG. 3 is a diagram of cross sectional views of alternative embodiments of a communication modification element that may be implemented in connection with the reactive armor of FIG. 1.

Referring to FIG. 3, cross sectional side elevation views, taken at line 3-3 of FIG. 2A, of alternative embodiments of a communication modifier (e.g., communication modification element and/or elements, check valve, restrictor, and the like) 140 that may be implemented in connection with the armor 100 are illustrated. For clarity, illustration of the propellant 106 is omitted. In addition, further details of alternative embodiments of the impacter 104 (e.g., impacters 104*f*-104*j*), and the passage 120 are illustrated in connection with the respective embodiments of the modifier 140.

The modifier 140 generally operates in connection with ignition of the explosive 106 to increase the velocity of the movement of the impacter 104 that results from the ignition and explosion of the propellant 106. The communication modifier 140 generally prevents the loss of propelling pressure through the ignition passage 120 by operation as a bidirectional check valve in the piston 104 that seals, wholly or in part, the passage 120 after the ignition of the propellant 106 at one section within the tube 102 has been communicated to the next charge of the explosive 106.

As implemented in the embodiment illustrated in FIG. 3, the impacter 104 may further comprise tapered (e.g., cone shaped, funnel shaped), inwardly oriented (i.e., longitudinally positioned having the base of the cone at the ends of the impacter 104 with the narrow portion of the cone towards middle) hollowed out (open) regions (e.g., chambers) 122 at one or both ends (both ends are illustrated having the tapered region 122) of the impacter 104. The region 122 generally provides additional capacity for the propellant 106 within the tube 102.

In one example (e.g., as implemented in connection with the impacter 1041), the check valve 140 may be implemented having a "barbell" shape where the stem (bar) of the barbell is within the passage 120 and the large ends of the barbell are within the regions 122 of the impacter 104. While illustrated having a "tappet" shape on FIG. 3, the barbell 140 ends may have any appropriate shape (e.g., spool shape). The barbell 140 generally rapidly moves longitudinally in response to the explosion of the propellant 106.

In another example, (e.g., as implemented in connection with the impacter 104*g*), the modifier 140 may be implemented as a ball that is contained within an enlarged region 124 of the passage 120. The valve 140 can be, for example, a metal ball that is retained (held in place) by a frangible or combustible retainer element 142 that is snugly positioned in the passage 120. In one embodiment, the retainer 142 may be implemented as a combustible material such as an explosive that is implemented mechanically to hold the ball 140 in place. In another example, the retainer 142 may be implemented as a frangible glass bead. In yet another example, the retainer 142 may be implemented as an adhesive bond. The ball 140 generally rapidly moves longitudinally in response to the explosion of the explosive propellant 106.

In another example, (e.g., as implemented in connection with the impacter 104*h*), the modifier 140 may be implemented as a valve (e.g., reed, flap, flapper, swing plate, hinge, tab, and the like) that is positioned at the entrance of the passage 120. When the explosive 106 is detonated, the force of the explosion will generally force the valve 140 to a substantially closed position across the passage 120.

In another example, (e.g., as implemented in connection with the impacter 104*i*), the modifier 140 may be implemented as a shaped charge igniter/plug that is held in place in front of the entrance of the passage 120 with a strut 144. In response to the detonation of the explosive mass element 106 causing the collapse of the shaped charge liner element (typically made of a ductile metal such as copper), a shaped charge device is known to generate as output two components: (i) a so-called jet having a tip which travels at an extremely high speed (e.g., about 30,000 feet per second); (ii) followed by a so-called slug which generally travels at a lower speed than the jet. The difference in velocity between the tip and tail (slug) of the jet (as well as other jet characteristics) is determined by the design of the "cone" or "liner" (i.e. included angle, wall thickness, material properties, and contour). A shaped charge may be specifically designed to enhance the diameter and mass of the slug while keeping a high tip speed.

For details of shaped charge construction and operation, see, for example, Newhouse, Paul, "A Primer on Shaped Charges", The Small Arms Review, Vol. 11, No. 1, October, 2007, pp. 94-97, which is incorporated by reference in its entirety. In any case, the details of shaped charge construction and operation would be well known and understood by one of skill in the relevant art.

The modifiers 140 that are illustrated in connection with the impacter 104*i*, may comprise the very small (e.g., having an outside diameter in the range of 5% to 25% of the outside diameter of the piston 104, and components sized accordingly per the Newhouse reference cited above) shaped charge 140. The shaped charge 140 generates a jet and a slug that are directed into the passage 120. The tip portion of the output of the shaped charge modifier 140 is used to pass through the center of the piston 104 aperture 120, and ignite the next charge, (the tip of shaped charge jets are generally the most effective form of energetic material initiation). The slug which follows the tip and is located in the rear portion of the jet from the shaped charge 140 then plugs the central passage 120 of the piston 104*i*.

In another example, (e.g., as implemented in connection with the impacter 104*j*), the modifier 140 may be implemented as a restriction (e.g., orifice, reduced cross section, choke point, etc.) within the passage 120. To generate the desired longitudinal force on the piston 104*j* when the explosive 106 is detonated, the small (e.g., having a diameter in the range of 3% to 15% of the outside diameter of the piston 104) orifice 140 connecting larger cross sectional area regions of the passage 120 is generally adequate (i.e., will not leak too much) to generate the desired force may be implemented.

The reactive armor 100 may further comprise an end sleeve (e.g., spacer, stand off, etc.) 150 positioned inside of the case 102 and between the outermost impacter 104 (e.g., the piston 104*j* and the end cap 108. The spacer 150 is generally implemented as a short tube, cylinder, and the like that fits snuggly inside the tube 102. The end sleeve 150 generally provides additional volume for the explosive 106 so that the piston element 104 that is nearest the end cap 108 (e.g., the piston 104*j*) can react as energetically as the other piston elements 104. While space could be provided within the end cap 108 to achieve the additional volume for the explosive 106, the implementation of the end sleeve 150 is generally preferable as more safe assembly of the armor 100 may be conducted when the explosive 106 is isolated from movement of the end cap 108 when the end cap 108 is screwed into place.

While not illustrated, any embodiment of the modifier 140 may be implemented in connection with the passage 120 on the inside of the inner wall of the case 102 as shown in connection with FIG. 2C.

The armor 100 may potentially mitigate, disrupt, diminish, reduce, and/or eliminate damaging or harmful effects from the threat 200 and collateral effects. The propelled impacter reactive armor 100 may be implemented as a plurality of assemblies 100. The armor 100 is generally positioned such that the anticipated direction of the threat 200 is intercepted, and the area to be protected is thus behind the armor 100 relative to the threat 200. The threat 200 may impact the tube 102 from any angle.

In one example, the armor 100 may be implemented positionally similar to the tubular packing bodies 3 of U.S. Pat. No. 4,665,794 which is incorporated by reference in its entirety; and in particular, as shown in FIGS. 1 and 4-9 and described throughout the patent document. In another example, the armor 100 may be implemented positionally similar to the tube and projectile apparatus (element 60) of U.S. Published Application 2006/0065111, on FIGS. 12-16 and in the related description at paragraphs [0067]-[0071], which is incorporated by reference in its entirety.

As is apparent then from the above detailed description, the present invention may provide an improved reactive armor 100, wherein the propelled impacters 104 are implemented within the housing 102 in connection with the explosive propellant 106 to act upon a variety of threats 200.

Various alterations and modifications will become apparent to those skilled in the art without departing from the scope and spirit of this invention and it is understood this invention is limited only by the following claims.

What is claimed is:

1. A reactive armor comprising:

a tube;

end caps installed on the ends of the tube;

a plurality of impacters included inside of the tube, each impacter having one or more passages formed therethrough;

explosive included between the impacters and between the end caps and the impacters; and a communication modifier positioned in an entrance of each passage of each impacter, each communication modifier comprising a shaped charge held in place by a strut;

wherein, each of said passages provides communication such that when a threat ruptures the tube, the explosive is progressively ignited from the rupture, and except for the rupture that results from intrusion of the threat, the tube remains essentially intact; and wherein, in response to the ignition of the explosive, each shaped charge is sequentially ignited as the ignition of the explosive progresses through the passages, each shaped charge generating a jet and a slug that are directed into and seal, wholly or in part, the passage in which the shaped charge is positioned.

2. The reactive armor of claim 1, wherein the tube and the end caps are formed from at least one of steel, aluminum, composite, cermet, and ceramic.

3. The reactive armor of claim 1, wherein the impacters are formed from at least one of steel, titanium, aluminum, composite, cermet, and ceramic.

4. The reactive armor of claim 1, wherein the impacters further comprise tapered, cone shaped with narrow end inwardly oriented hollowed out regions at one or both ends of the impacter.

5. The reactive armor of claim 4, wherein the impacters are substantially adjacent.

6. The reactive armor of claim 1, wherein the reactive armor further comprises an end sleeve positioned inside of the tube and between the outermost impacter and the end cap.

7. The reactive armor of claim 1, wherein each shaped charge has an outside diameter in the range of 5% to 25% of the outside diameter of the impacter.

* * * * *